US012345256B2

(12) United States Patent
Araki et al.

(10) Patent No.: US 12,345,256 B2
(45) Date of Patent: Jul. 1, 2025

(54) SCROLL COMPRESSOR

(71) Applicant: DAIKIN INDUSTRIES, LTD., Osaka (JP)

(72) Inventors: Kosuke Araki, Osaka (JP); Yoshitomo Tsuka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/430,145

(22) Filed: Feb. 1, 2024

(65) Prior Publication Data

US 2024/0167473 A1 May 23, 2024

Related U.S. Application Data

(63) Continuation of application No. PCT/JP2022/026569, filed on Jul. 4, 2022.

(30) Foreign Application Priority Data

Aug. 4, 2021 (JP) ..... 2021-128189

(51) Int. Cl.
*F04C 29/00* (2006.01)
*F04C 15/06* (2006.01)
(Continued)

(52) U.S. Cl.
CPC ..... *F04C 18/0215* (2013.01); *F04C 18/0261* (2013.01); *F04C 23/008* (2013.01); *F04C 29/12* (2013.01)

(58) Field of Classification Search
CPC ..... F04C 18/0215; F04C 18/0253; F04C 18/0261; F04C 18/0246; F04C 29/12
See application file for complete search history.

(56) References Cited

U.S. PATENT DOCUMENTS

2012/0294748 A1 11/2012 Shibayashi et al.
2018/0238330 A1 8/2018 Tsuka

FOREIGN PATENT DOCUMENTS

EP 3578823 A1 * 12/2019 ..... F04C 18/0215
JP H03145589 A * 6/1991 ..... F04C 18/02
(Continued)

OTHER PUBLICATIONS

English translation of EP 3578823 by PE2E.*
(Continued)

*Primary Examiner* — Deming Wan
(74) *Attorney, Agent, or Firm* — GLOBAL IP COUNSELORS, LLP

(57) ABSTRACT

A high pressure dome scroll compressor includes a compression mechanism having fixed and orbiting scrolls to form a compression chamber, a casing housing the compression mechanism, and first and second passage members. The first and second passage members guide low and intermediate pressure fluid from outside of the casing to the compression mechanism. The fixed scroll has a fixed end plate, a fixed wrap, and an outer peripheral wall surrounding the fixed wrap. The fixed end plate has suction and injection passages connected with the first and second passage members to guide the low and intermediate pressure fluid to the compression chamber. The fixed end plate has an attachment portion to which the first and second passage members are attached. The attachment portion is part of a back surface of the fixed end plate and protrudes on the back surface of the fixed end plate.

4 Claims, 6 Drawing Sheets

(51) Int. Cl.

| | |
|---|---|
| ***F04C 18/02*** | (2006.01) |
| ***F04C 23/00*** | (2006.01) |
| ***F04C 29/12*** | (2006.01) |

(56) References Cited

FOREIGN PATENT DOCUMENTS

| | | | |
|---|---|---|---|
| JP | 7-133771 | A | 5/1995 |
| JP | 2001-304153 | A | 10/2001 |
| WO | 2016/137003 | A1 | 9/2016 |

OTHER PUBLICATIONS

English copy of JP-H03145589 by PE2E Jul. 3, 2024.*
International Search Report of corresponding PCT Application No. PCT/JP2022/026569 dated Aug. 23, 2022.
European Search Report of corresponding EP Application No. 22 85 2766.9 dated Sep. 27, 2024.
International Preliminary Report of corresponding PCT Application No. PCT/JP2022/026569 dated Feb. 15, 2024.

* cited by examiner

SCROLL COMPRESSOR

CROSS-REFERENCE TO RELATED APPLICATIONS

This is a continuation of International Application No. PCT/JP2022/026569 filed on Jul. 4, 2022, which claims priority to Japanese Patent Application No. 2021-128189, filed on Aug. 4, 2021. The entire disclosures of these applications are incorporated by reference herein.

BACKGROUND

Technical Field

The present disclosure relates to a scroll compressor and a refrigeration apparatus.

Background Art

Japanese Unexamined Patent Publication No. H07-133771 discloses a high-pressure dome-type scroll compressor. The scroll compressor includes a suction pipe. The suction pipe passes through a casing and is connected to a fixed scroll to guide a low-pressure refrigerant to a compression chamber.

In the high-pressure dome-type scroll compressor, the fixed scroll is exposed to a high-temperature, high-pressure refrigerant with which the casing is filled. Thus, if no countermeasure is taken, the low-pressure refrigerant is heated by the high-pressure refrigerant in the casing while the refrigerant flows from the suction pipe to the compression chamber. As a result, the density of the low-pressure refrigerant sucked into the compression chamber decreases, thereby decreasing the operating efficiency of the scroll. Specifically, the mass of the refrigerant sucked into the compression chamber decreases every time the orbiting scroll makes one rotation.

In view of this fact, in the scroll compressor of Japanese Unexamined Patent Publication No. H07-133771, the suction pipe is surrounded by an inlet tube to reduce the amount of heat transferred to the low-pressure refrigerant flowing through the suction pipe.

SUMMARY

A first aspect of the present disclosure is directed to a high-pressure dome-type scroll compressor includes a compression mechanism, a casing, a first passage member, and a second passage member. The compression mechanism includes a fixed scroll and an orbiting scroll. The fixed scroll and orbiting scroll form a compression chamber. The casing houses the compression mechanism. The compression mechanism is configured to compress a fluid and discharge a compressed fluid into an internal space of the casing. The first passage member is configured to guide a low-pressure fluid from outside of the casing to the compression mechanism. The second passage member is configured to guide an intermediate-pressure fluid from outside of the casing to the compression mechanism. The fixed scroll has a fixed end plate, a fixed wrap protruding from a front surface of the fixed end plate, and an outer peripheral wall disposed on a front surface side of the fixed end plate and surrounding a periphery of the fixed wrap. The fixed end plate has a suction passage connected with the first passage member to guide the low-pressure fluid to the compression chamber, and an injection passage connected with the second passage member to guide the intermediate-pressure fluid to the compression chamber. The fixed end plate has an attachment portion to which the first passage member and the second passage member are both attached. The attachment portion is part of a back surface of the fixed end plate and protrudes on the back surface of the fixed end plate.

DETAILED DESCRIPTION OF EMBODIMENT(S)

Figure 1:
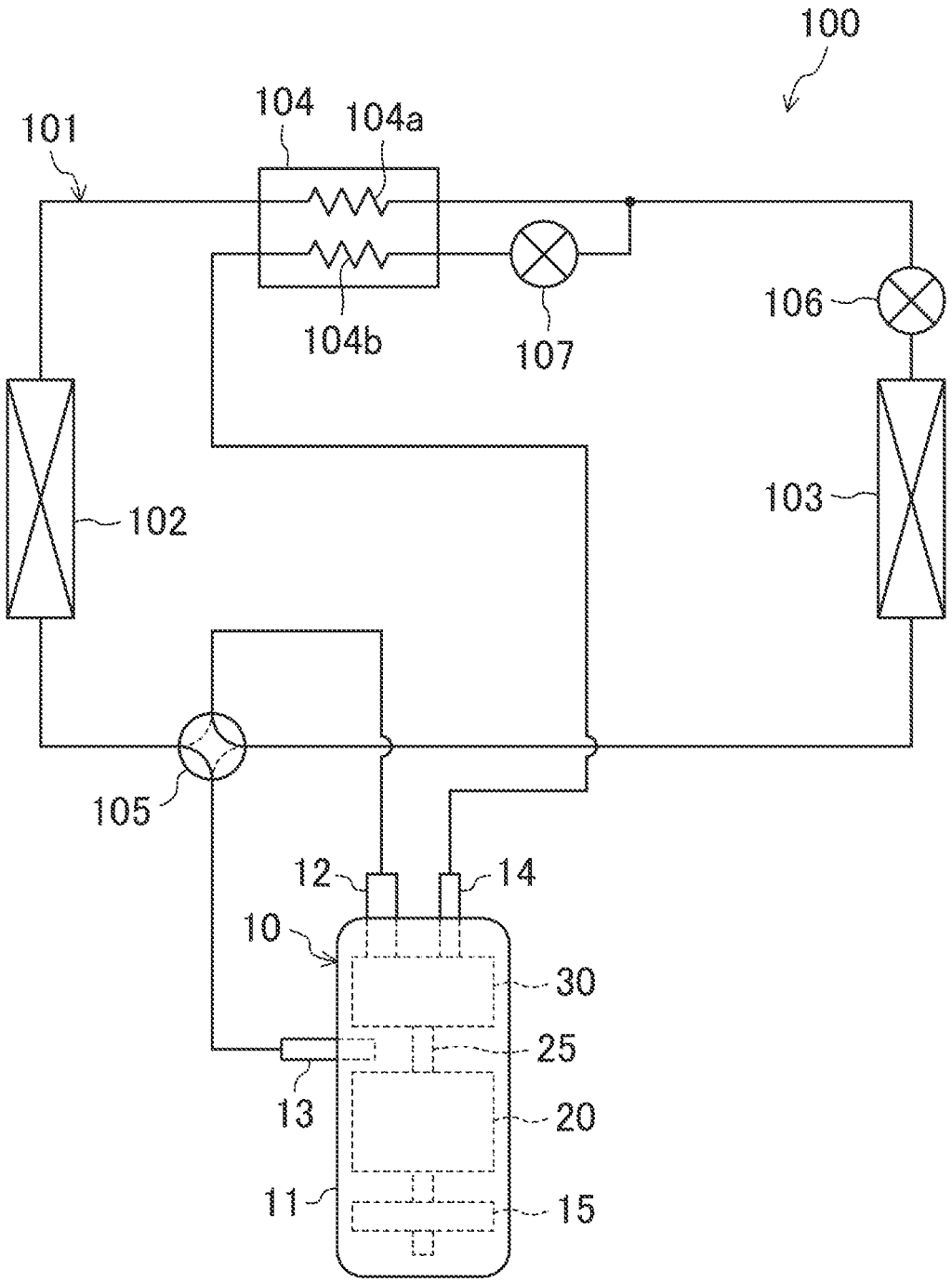
FIG. 1 is a piping system diagram illustrating a refrigerant circuit of a refrigeration apparatus.

A scroll compressor (10) of an embodiment will be described below. The scroll compressor (10) is connected to a refrigerant circuit (101) of a refrigeration apparatus (100) to compress a fluid refrigerant.

Refrigeration Apparatus

The refrigeration apparatus (100) provided with the scroll compressor (10) will be described with reference to FIG. 1.

The refrigerant circuit (101) of the refrigeration apparatus (100) is provided with the scroll compressor (10) of the present embodiment, a heat-source-side heat exchanger (102), a utilization-side heat exchanger (103), a subcooling heat exchanger (104), a four-way switching valve (105), an expansion valve (106), and an injection valve (107).

A suction pipe (12) and a discharge pipe (13) of the scroll compressor (10) are connected to the four-way switching valve (105). A gas end of the heat-source-side heat exchanger (102) is connected to the four-way switching valve (105). A liquid end of the heat-source-side heat exchanger (102) is connected to an inlet of a first channel (104*a*) of the subcooling heat exchanger (104). An outlet of the first channel (104*a*) of the subcooling heat exchanger (104) is connected to one end of the expansion valve (106). The other end of the expansion valve (106) is connected to a liquid end of the utilization-side heat exchanger (103). A gas end of the utilization-side heat exchanger (103) is connected to the four-way switching valve (105).

One end of the injection valve (107) is connected to a pipe connecting the first channel (104*a*) of the subcooling heat exchanger (104) and the expansion valve (106). The other end of the injection valve (107) is connected to an inlet of a second channel (104*b*) of the subcooling heat exchanger (104). An outlet of the second channel (104*b*) of the subcooling heat exchanger (104) is connected to an injection pipe (14) of the scroll compressor (10).

The heat-source-side heat exchanger (102) and the utilization-side heat exchanger (103) are each a heat exchanger that exchanges heat between the refrigerant and the air. The subcooling heat exchanger (104) is a heat exchanger that exchanges heat between the refrigerant flowing through the first channel (104*a*) and the refrigerant flowing through the second channel (104*b*). The expansion valve (106) and the injection valve (107) are each an electronic expansion valve having a variable opening degree. The four-way switching valve (105) is a switching valve that switches between a cooling operation and a heating operation in the refrigeration apparatus (100).

During the cooling operation, the four-way switching valve (105) falls into the state indicated by solid curves in FIG. 1, the heat-source-side heat exchanger (102) functions as a condenser, and the utilization-side heat exchanger (103) functions as an evaporator. (10) During the cooling operation, the high-pressure refrigerant having discharged from the scroll compressor (10) is sent to the heat-source-side heat exchanger (102), the low-pressure refrigerant having evaporated in the utilization-side heat exchanger (103) is sucked into the scroll compressor (10), and an intermediate-pressure refrigerant having evaporated in the second channel (104*b*) of the subcooling heat exchanger (104) flows into the injection pipe (14) of the scroll compressor (10).

During the heating operation, the four-way switching valve (105) falls into the state indicated by broken curves in FIG. 1, the utilization-side heat exchanger (103) functions as a condenser, and the heat-source-side heat exchanger (102) functions as an evaporator. During the heating operation, the high-pressure refrigerant having discharged from the scroll compressor (10) is sent to the utilization-side heat exchanger (103), the low-pressure refrigerant having evaporated in the heat-source-side heat exchanger (102) is sucked into the scroll compressor (10), and the intermediate-pressure refrigerant having evaporated in the second channel (104*b*) of the subcooling heat exchanger (104) flows into the injection pipe (14) of the scroll compressor (10).

General Configuration of Scroll Compressor

As illustrated in FIG. 1, the scroll compressor (10) is a hermetic compressor. The scroll compressor (10) is configured such that a compression mechanism (30) and an electric motor (20) are housed in a casing (11) which is a closed container.

The casing (11) is a cylindrical pressure vessel having closed ends. The casing (11) is arranged so that its axial direction extends in a top-to-bottom direction.

The casing (11) is provided with a suction pipe (12) and a discharge pipe (13). The suction pipe (12) is a member for introducing a low-pressure refrigerant from the outside of the casing (11) into the compression mechanism (30). The suction pipe (12) passes through an upper end of the casing (11) and is connected to the compression mechanism (30). The discharge pipe (13) is a member for discharging a high-pressure refrigerant to the outside of the casing (11) which has discharged from the compression mechanism (30). The discharge pipe (13) passes through a barrel of the casing (11) and is open to the internal space of the casing (11).

The casing (11) is provided with an injection pipe (14). The injection pipe (14) passes through the upper end of the casing (11) and is connected to the compression mechanism (30). The injection pipe (14) is a member for introducing the intermediate-pressure refrigerant from the outside of the casing (11) into the compression mechanism (30).

Inside the casing (11), the electric motor (20) is arranged below the compression mechanism (30). The electric motor (20) is connected to the compression mechanism (30) via a drive shaft (25) to drive the compression mechanism (30).

A lower bearing member (15) is provided in a lower space in the casing (11). The lower bearing member (15) forms a journal bearing that supports the drive shaft (25).

Configuration of Compression Mechanism

Figure 2:
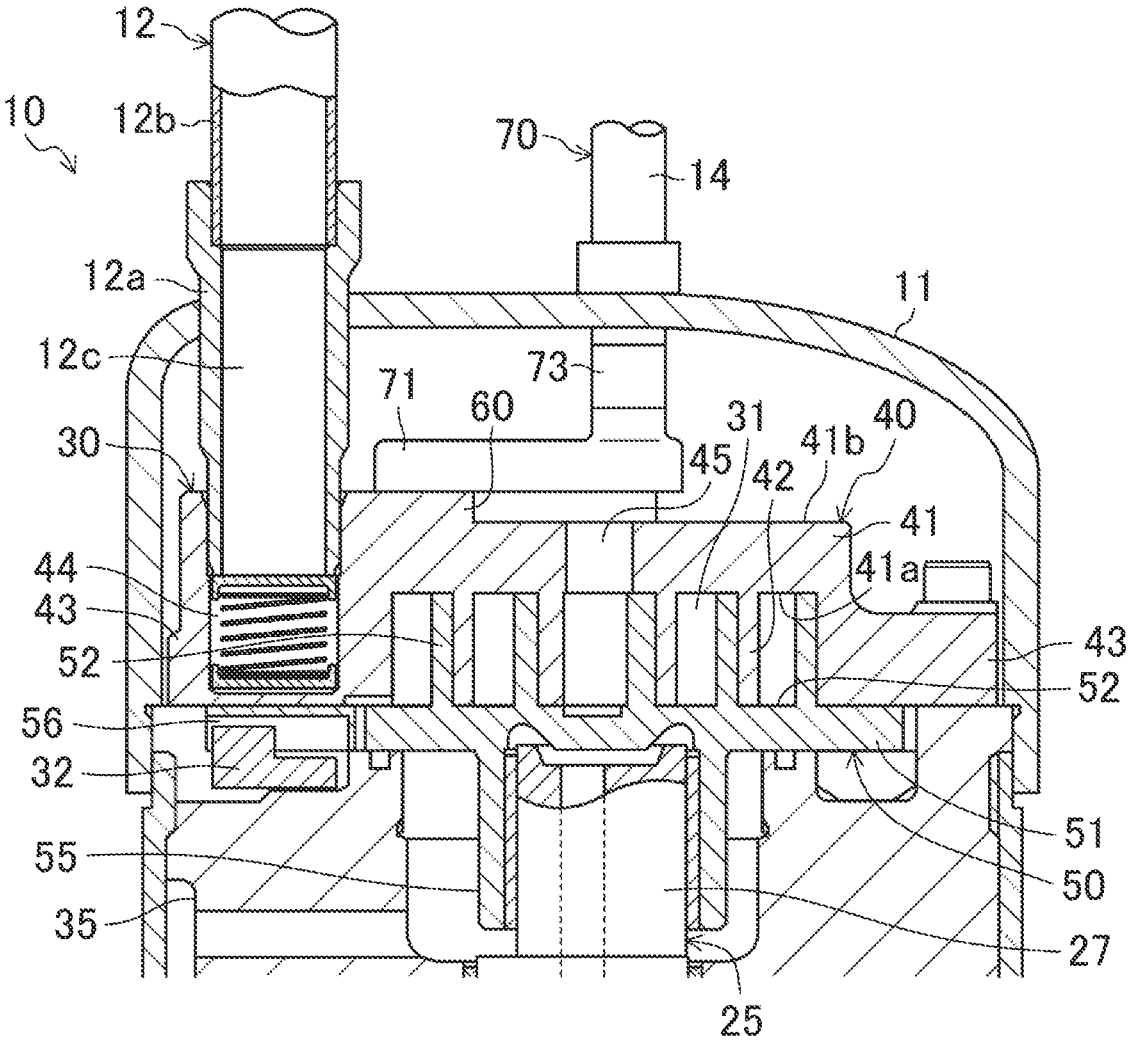
FIG. 2 is a vertical cross-sectional view of a compression mechanism of a scroll compressor.

As illustrated in FIG. 2, the compression mechanism (30) includes a housing (35), a fixed scroll (40), an orbiting scroll (50), and an Oldham coupling (32). The housing (35) is fixed to the casing (11). The fixed scroll (40) is arranged on an upper surface of the housing (35). The orbiting scroll (50) is arranged between the fixed scroll (40) and the housing (35).

The housing (35) is a dish-like shaped member with a recessed center. The housing (35) forms a journal bearing that supports the drive shaft (25).

The fixed scroll (40) includes a fixed end plate (41), a fixed wrap (42), and an outer peripheral wall (43). The fixed end plate (41) is a slightly thicker flat plate-shaped portion. The fixed wrap (42) is in the shape of a spiral wall that draws an involute curve, and protrudes from the front surface (41*a*) of the fixed end plate (41). The outer peripheral wall (43) surrounds the outer periphery of the fixed wrap (42) and protrudes from the front surface of the fixed end plate (41). An end face of the fixed wrap (42) is substantially flush with an end face of the outer peripheral wall (43).

The orbiting scroll (50) includes an orbiting end plate (51), an orbiting wrap (52), and a boss (55). The orbiting end plate (51) is in a substantially cylindrical flat plate. The orbiting wrap (52) is formed in a spiral wall shape that draws an involute curve, and protrudes from a front surface (upper surface in FIG. 2) of the orbiting end plate (51). The boss (55) is in a cylindrical shape, and is disposed on a central portion of the back surface (lower surface in FIG. 2) of the orbiting end plate (51). An eccentric portion (27) of the drive shaft (25) is inserted into the boss (55).

The Oldham coupling (32) is arranged between the orbiting scroll (50) and the housing (35). The Oldham coupling (32) engages with the orbiting scroll (50) and the housing (35) and restricts the autorotation of the orbiting scroll (50).

In the compression mechanism (30), the fixed scroll (40) and the orbiting scroll (50) form compression chambers (31). In the compression mechanism (30), the fixed wrap (42) and the orbiting wrap (52) mesh with each other to form a plurality of compression chambers (31).

Fixed Scroll

The fixed scroll (40) will be described with reference to FIGS. 2 to 6 as appropriate.

Figure 3:
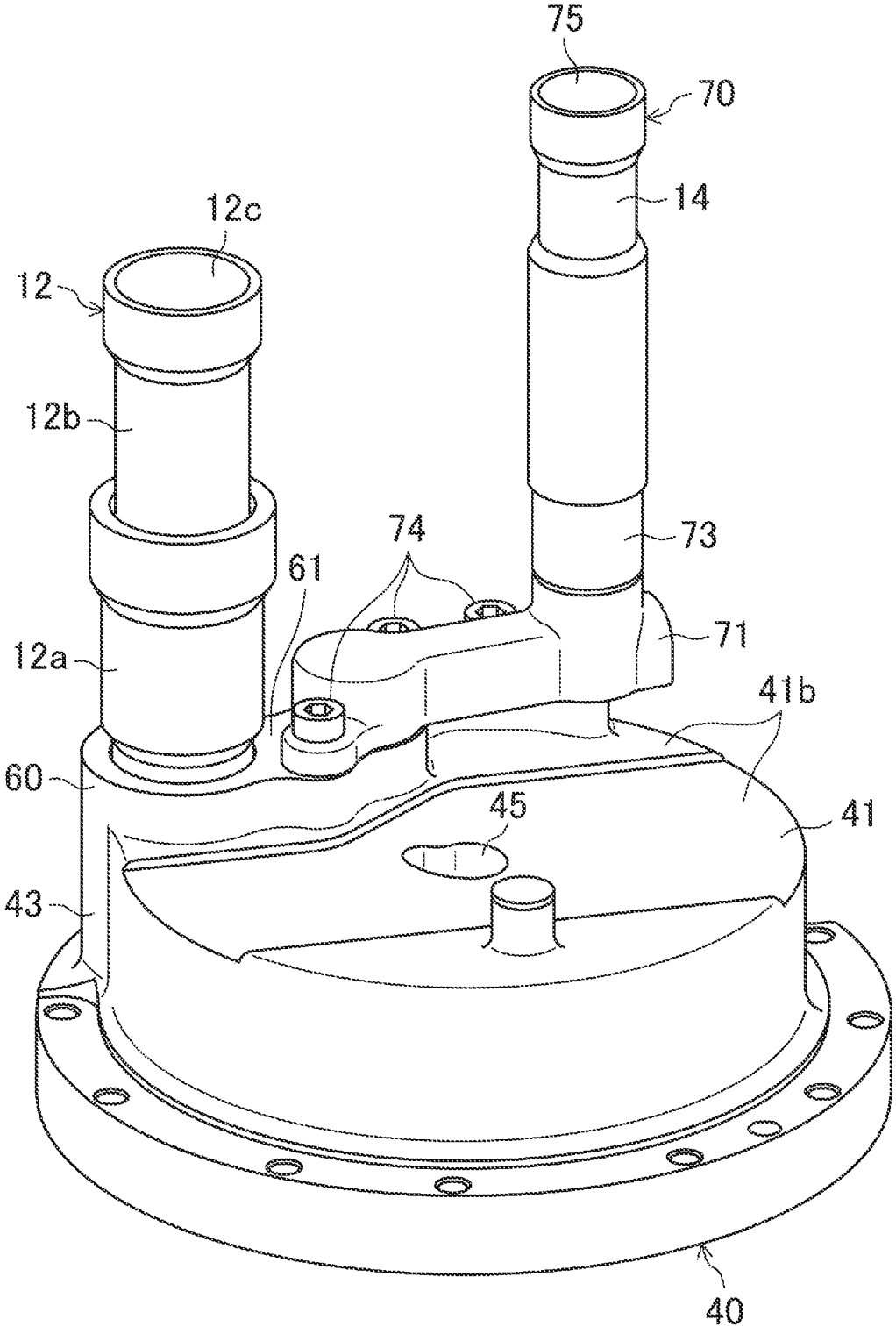
FIG. 3 is a perspective view of the compression mechanism without housing.
Figure 4:
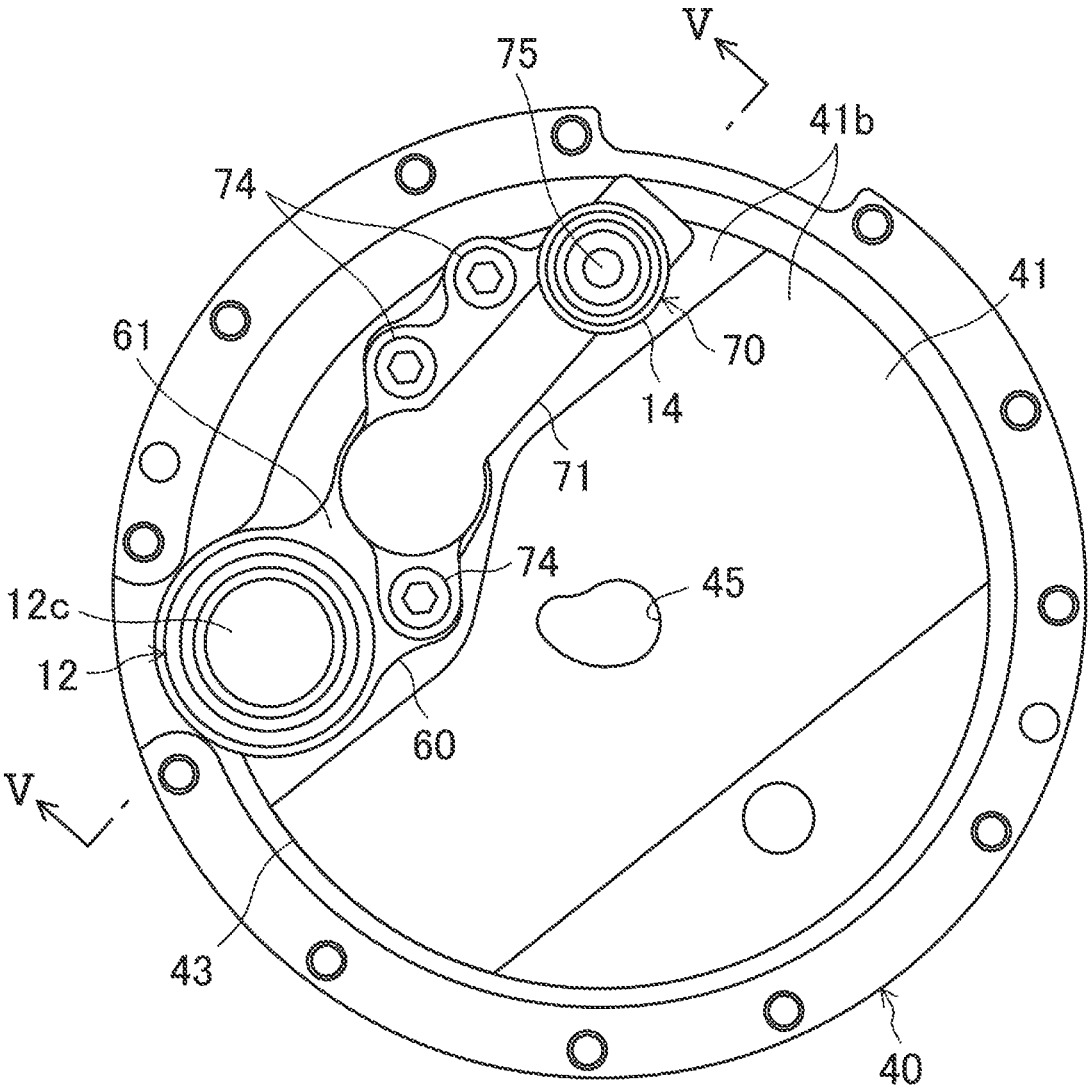
FIG. 4 is a plan view of the compression mechanism.

As illustrated in FIGS. 2 and 3, an outlet (45) is provided in the fixed end plate (41). The outlet (45) is a through hole provided in a central portion of the fixed end plate (41). The outlet (45) is open on the front surface (41*a*) and the back surface (41*b*) of the fixed end plate (41). The outlet (45) forms a passage through which the refrigerant having compressed in each compression chamber (31) is guided to the internal space of the casing (11).

Figure 6:
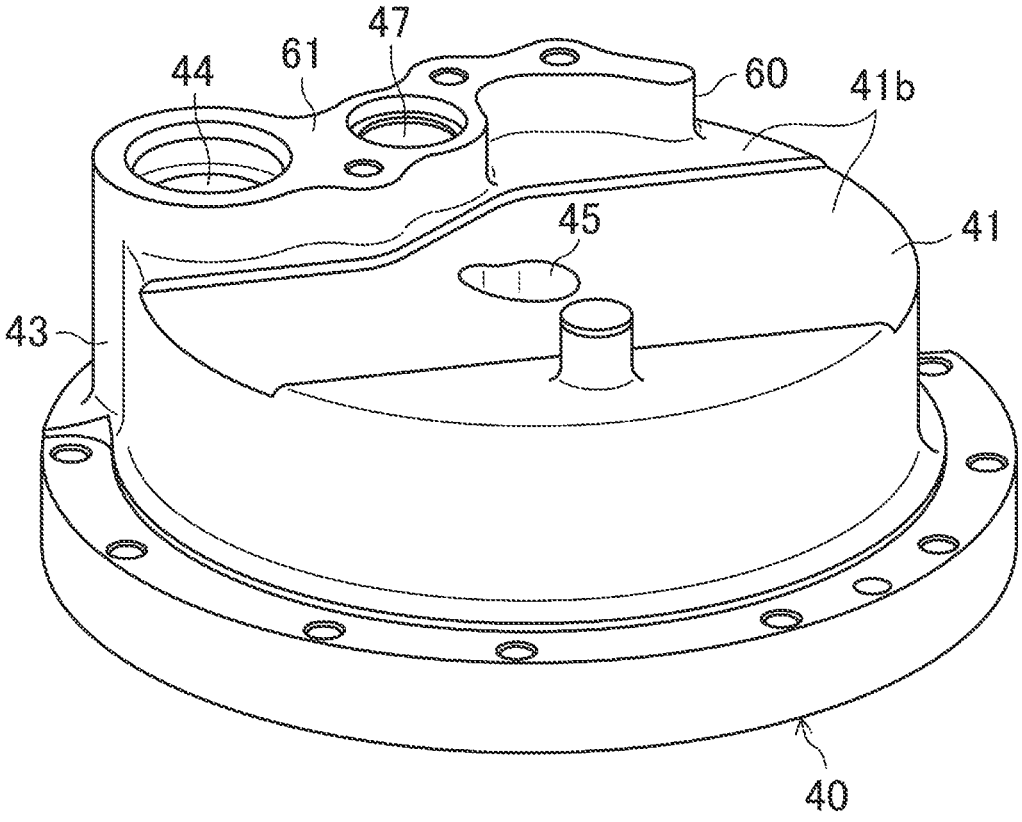
FIG. 6 is a perspective view of a fixed scroll.

As illustrated in FIG. 6, an attachment portion (60) is provided in the fixed end plate (41). The attachment portion (60) is a portion that protrudes on the back surface of the fixed end plate (41). The attachment portion (60) is provided near the outer periphery of the fixed end plate (41). The attachment portion (60) has an elongated shape substantially along the outer periphery of the fixed end plate (41) in plan view. The end face (the upper surface in FIG. 6) of the attachment portion (60) is a flat surface having been subjected to machining.

Figure 5:
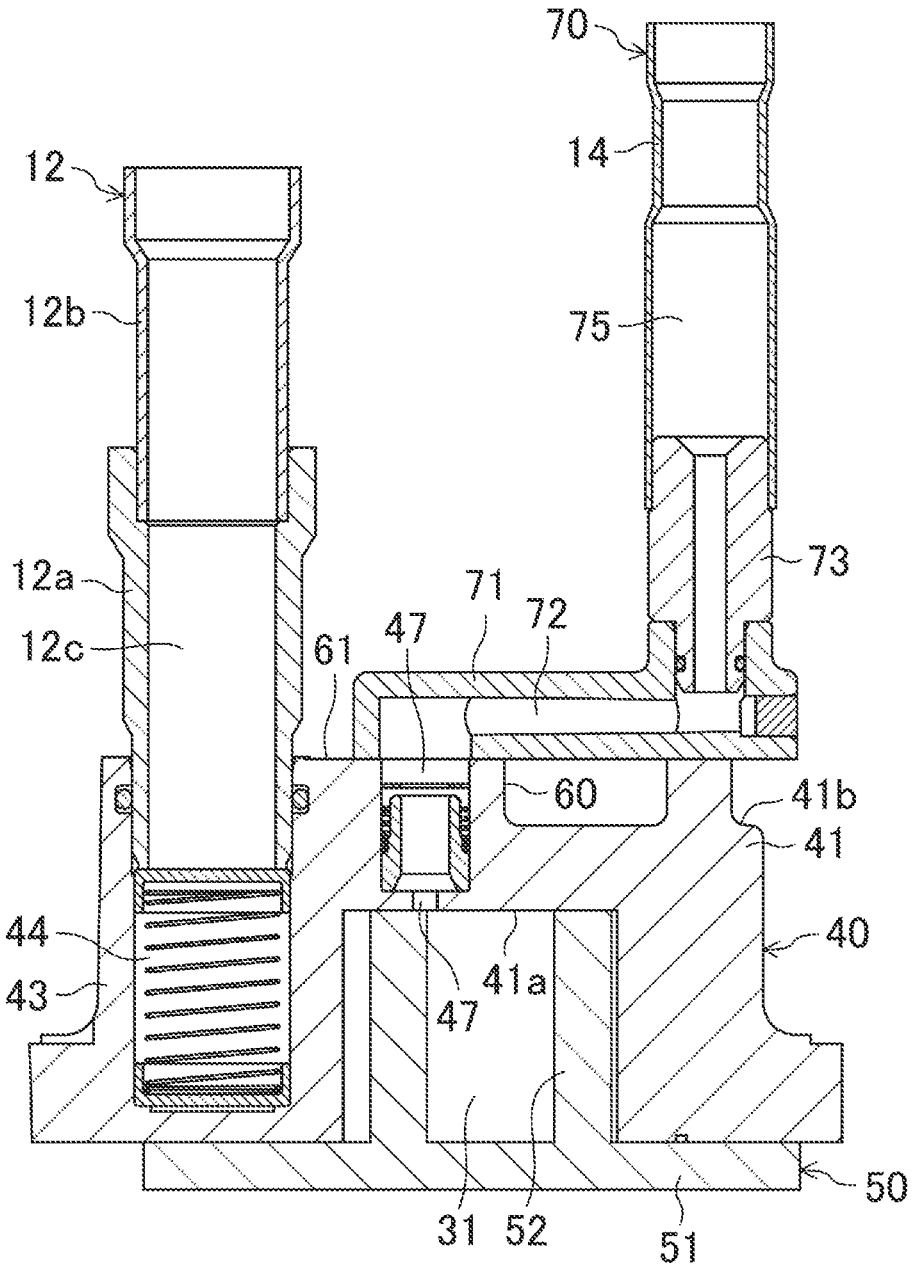
FIG. 5 is cross-sectional view of the compression mechanism taken along line V-V of FIG. 4.

As illustrated in FIGS. 2, 5, and 6, a suction passage (44) is provided in the fixed scroll (40). The suction passage (44) is a vertical hole formed from the attachment portion (60) of the fixed end plate (41) along the outer peripheral wall (43).

One end of the suction passage (44) is open on the end face (61) of the attachment portion (60). The suction passage (44) is a passage through which the low-pressure refrigerant is guided to the compression chamber (31).

As illustrated in FIGS. 5 and 6, an injection passage (47) is provided in the fixed scroll (40). The injection passage (47) is a through hole provided in the fixed end plate (41). The center axis of the injection passage (47) extends in the top-to-bottom direction.

One end of the injection passage (47) is open on the end face (61) of the attachment portion (60). The other end of the injection passage (47) is open on the front surface (41*a*) of the fixed end plate (41). The injection passage (47) is a passage through which the intermediate-pressure refrigerant is guided to compression chamber (31) in the course of compression (in other words, in the closed state).

First Passage Member (Suction Pipe)

As illustrated in FIGS. 2 to 5, a first passage member is attached to the attachment portion (60) of the fixed end plate (41). In the scroll compressor (10) of the present embodiment, the suction pipe (12) forms the first passage member. The suction pipe (12) allows introduction of the low-pressure refrigerant from the outside of the casing (11) to the compression mechanism (30).

The suction pipe (12) includes a main pipe (12*a*) and a sub pipe (12*b*). The suction pipe (12) forms a low-pressure passage (12*c*) through which the low-pressure refrigerant flows. The low-pressure passage (12*c*) is connected to the suction passage (44) provided in the fixed scroll (40).

The main pipe (12*a*) is a cylindrical member. The main pipe (12*a*) is provided through the top of the casing (11). One end of the main pipe (12*a*) is inserted from an end face (61) of the attachment portion (60) to the suction passage (44). The main pipe (12*a*) is connected to the suction passage (44). The other end of the main pipe (12*a*) is exposed to the outside of the casing (11).

The sub pipe (12*b*) is a cylindrical member. One end of the sub pipe (12*b*) is inserted into the other end of the main pipe (12*a*). The other end of the sub pipe (12*b*) is connected with a pipe forming the refrigerant circuit (101).

Second Passage Member

As illustrated in FIGS. 2 to 5, a second passage member (70) is attached to the attachment portion (60) of the fixed end plate (41). The second passage member (70) includes a connecting member (71), a joint member (73), and an injection pipe (14).

The connecting member (71) is a laterally oriented block-shaped member. The connecting member (71) is fixed to the attachment portion (60) of the fixed end plate (41) by three bolts (74). The lower surface of the connecting member (71) is in close contact with the end face (61) of the attachment portion (60).

An internal passage (72) is provided in the connecting member (71). The internal passage (72) is an elongated passage extending in the longitudinal direction of the connecting member (71). An inlet end of the internal passage (72) is bent upward and open on the upper surface of one end portion of the connecting member (71). An outlet end of the internal passage (72) is bent downward and open on the lower surface of the other end portion of the connecting member (71). The outlet end of the internal passage (72) overlaps one end of the injection passage (47) which is open on the end face (61) of the attachment portion (60). The internal passage (72) communicates with the injection passage (47).

The joint member (73) is attached to the one end portion of the connecting member (71). The joint member (73) is a slightly thick short cylindrical member. The joint member (73) is attached to the connecting member (71) so that its axial direction corresponds to the top-to-bottom direction. One end (the lower end in FIG. 5) of the joint member (73) is inserted into the inlet end of the internal passage (72) that is open on the upper surface of the connecting member (71).

The injection pipe (14) is a cylindrical member. The injection pipe (14) is arranged such that its axial direction corresponds to the top-to-bottom direction, and passes through the top of the casing (11). The axial direction of the injection pipe (14) is substantially parallel with the axial direction of the injection passage (47), and offsets laterally with respect to the axial direction of the injection passage (47). One end of the injection pipe (14) is connected to the other end (the upper end in FIG. 5) of the joint member (73). The other end of the injection pipe (14) is exposed to the outside of the casing (11). The other end of the injection pipe (14) is connected with a pipe forming the refrigerant circuit (101).

Together with the internal passage (72) of the connecting member (71), the internal space of injection pipe (14) and the internal space of the joint member (73) form an intermediate-pressure passage (75) through which the intermediate-pressure refrigerant flows. The intermediate-pressure passage (75) is connected to the injection passage (47) to guide the intermediate-pressure refrigerant to the injection passage (47).

In the second passage member (70), a joint member (73) may be omitted. In such a case, the injection pipe (14) is connected directly to the inlet end of the internal passage (72) of the connecting member (71).

Operation of Scroll Compressor

In the scroll compressor (10), the orbiting scroll (50) of the compression mechanism (30) is driven by the electric motor (20) to perform an orbital motion. When the orbiting scroll (50) moves, the low-pressure refrigerant having flowed from the suction pipe (12) into the suction passage (44) flows into the compression chamber (31).

As the orbiting scroll (50) moves, the compression chamber (31) moves from the outer peripheral end of the fixed wrap (42) to the central end, and with this movement, the volume of the compression chamber (31) decreases, thereby compressing the refrigerant inside the compression chamber (31).

The intermediate-pressure refrigerant flowing through the injection pipe (14) is introduced into the compression mechanism (30). The intermediate-pressure refrigerant flowing through the injection pipe (14) passes through the joint member (73) and the connecting member (71) in this order, then flows into the injection passage (47), and is then introduced into the compression chamber (31) in the course of compression.

The refrigerant having compressed in the compression chamber (31) passes through the outlet (45) from the compression chamber (31) and is discharged into a space above the compression mechanism (30) in the casing (11). The high-pressure refrigerant having discharged from the compression mechanism (30) flows into a space below the housing (35) in the casing (11), and then flows to the outside of the casing (11) through the discharge pipe (13).

Cooling of Fixed Scroll by Intermediate-Pressure Refrigerant

In the scroll compressor (10) of the present embodiment, the fixed scroll (40) is exposed to the high-temperature, high-pressure refrigerant discharged from the compression mechanism (30). Thus, not only a portion near the middle of the fixed scroll (40) provided with the outlet (45), but also a portion near the outer periphery of the fixed scroll (40) provided with the suction passage (44) are heated by the refrigerant having discharged from the compression mechanism (30).

Therefore, if no countermeasure is taken, the low-pressure refrigerant having been supplied from the suction pipe (12) to the compression mechanism (30) is heated when passing through the suction passage (44) of the fixed scroll (40), thereby decreasing the density. If the density of the low-pressure refrigerant flowing from the suction passage (44) to the compression chamber (31) decreases, the mass of the low-pressure refrigerant sucked into the compression chamber (31) during one rotation of the orbiting scroll (50) decreases, thereby reducing operating efficiency of the scroll compressor (10).

In the scroll compressor (10) of the present embodiment, the suction pipe (12) as a first passage member and a connecting member (71) forming a second passage member (70) are both attached to the single attachment portion (60) provided in the fixed scroll (40). Further, the suction passage (44) and the injection passage (47) are both provided in the single attachment portion (60).

The temperature of the intermediate-pressure refrigerant flowing through the injection passage (47) is lower than the temperature of the high-pressure refrigerant having discharged from the compression mechanism (30). Thus, in the compression mechanism (30) of the present embodiment, the intermediate-pressure refrigerant having a temperature lower than the high-pressure refrigerant flows near a portion around the suction passage (44) in the fixed scroll (40). Thus, the portion around the suction passage (44) in the fixed scroll (40) is cooled by the intermediate-pressure refrigerant flowing through the injection passage (47). Consequently, there is less increase in a temperature of the low-pressure refrigerant that is passing through the suction passage (44) of the fixed scroll (40), thereby improving operating efficiency of the scroll compressor (10).

Here, some conventional scroll compressors have employed a structure containing two attachment portions both provided in the fixed end plate of the fixed scroll and protruding on the back surface of the fixed end plate, where the suction pipe (12) as a first passage member is attached to one of the two attachment portions, and the second passage member (70) is attached to the other one of the two attachment portions. In such a structure, a portion between the two attachment portions in the fixed end plate is thinner than the portions provided with the attachment portions in the fixed end plate. In the fixed scroll, the relatively thin portion between the two attachment portions inhibits thermal conduction from a portion around the suction passage to a portion around the injection passage.

In contrast, as mentioned above, in the scroll compressor (10) of the present embodiment, the suction pipe (12) as a first passage member and the connecting member (71) forming the second passage member (70) are both attached to the single attachment portion (60) provided in the fixed scroll (40). Further, the suction passage (44) and the injection passage (47) are both provided in the single attachment portion (60). Thus, in the fixed scroll (40) of the present embodiment, the entire region between a portion provided with the suction passage (44) and a portion provided with the injection passage (47) is a relatively thick portion in the fixed end plate (41).

Therefore, the fixed scroll (40) of the present embodiment more facilitates thermal conduction from the portion provided with the suction passage (44) to the portion provided with the injection passage (47) than the conventional fixed scroll does which has a structure containing the attachment portion for the suction pipe and the attachment portion for the second passage member separately. Consequently, there is less increase in a temperature of the low-pressure refrigerant that is passing through the suction passage (44) of the fixed scroll (40), thereby improving operating efficiency of the scroll compressor (10).

Feature (1) of Embodiment

In the scroll compressor (10) of the present embodiment, the attachment portion (60) is provided in the fixed end plate (41) of the fixed scroll (40). The suction pipe (12) through which a low-pressure refrigerant flows and the second passage member (70) through which an intermediate-pressure refrigerant flows are both attached to the attachment portion (60). The low-pressure refrigerant having flowed from the suction pipe (12) to the compression mechanism (30) and the intermediate-pressure refrigerant having flowed from the second passage member (70) to the compression mechanism (30) come into contact with the attachment portion (60). The attachment portion (60) exposed to a high-pressure refrigerant in the casing (11) is cooled by the intermediate-pressure refrigerant supplied from the second passage member (70) to the compression mechanism (30). Thus, there is less increase in a temperature of the low-pressure refrigerant flowing in contact with the attachment portion (60). Consequently, there is less decrease in the density of the low-pressure refrigerant flowing into the compression chamber (31), thereby improving operating efficiency of the scroll compressor (10).

Feature (2) of Embodiment

In the scroll compressor (10) of the present embodiment, the second passage member (70) includes an injection pipe (14) and a connecting member (71). The injection pipe (14) is offset from the axial direction of the injection passage (47). Thus, a certain distance is ensured between the suction pipe (12) and the injection pipe (14).

A pipe forming a refrigerant circuit (101) is connected to each of the suction pipe (12) and the injection pipe (14) by brazing or the like. According to the present embodiment, a certain distance is ensured between the suction pipe (12) and the injection pipe (14), and this facilitates operation of connecting a pipe to each of the suction pipe (12) and the injection pipe (14).

While the embodiments and variations thereof have been described above, it will be understood that various changes in form and details may be made without departing from the spirit and scope of the claims. The above-described embodiments and variations may be combined and replaced with each other without deteriorating intended functions of the present disclosure. The ordinal numbers such as "first," "second," "third," . . . in the description and claims are used to distinguish the terms to which these expressions are given, and do not limit the number and order of the terms.

As can be seen from the foregoing description, the present disclosure is useful for a scroll compressor and a refrigeration apparatus.

The invention claimed is:

1. A high pressure dome scroll compressor comprising:

a compression mechanism including a fixed scroll and an orbiting scroll, the fixed scroll and orbiting scroll forming a compression chamber;

a casing housing the compression mechanism, the compression mechanism being configured to compress a fluid and discharge a compressed fluid into an internal space of the casing;

a first passage member configured to guide a low-pressure fluid from outside of the casing to the compression mechanism; and a second passage member configured to guide an intermediate-pressure fluid from outside of the casing to the compression mechanism, the fixed scroll having a fixed end plate, a fixed wrap protruding from a front surface of the fixed end plate, and an outer peripheral wall disposed on a front surface side of the fixed end plate and surrounding a periphery of the fixed wrap, the fixed scroll being a single member with the fixed end plate, the fixed wrap, and the outer peripheral wall formed integrally with each other, the fixed end plate having a suction passage connected with the first passage member to guide the low-pressure fluid to the compression chamber, and an injection passage connected with the second passage member to guide the intermediate-pressure fluid to the compression chamber, the fixed end plate having an attachment portion to which the first passage member and the second passage member are both attached, the attachment portion being a portion protruding in a thickness direction of the fixed end plate from a part of a back surface of the fixed end plate, the back surface of the fixed end plate including a first surface, which is a protruding end face of the attachment portion, and a second surface lower than the first surface in a protruding direction of the attachment portion, one end of the suction passage and one end of the injection passage being open on the first surface, which is an end face of the attachment portion, and an outlet in which compressed refrigerant in the compression chamber flows being open on the second surface.

2. The scroll compressor of claim 1, wherein the injection passage passes through the fixed end plate in a thickness direction of the fixed end plate, and the second passage member includes an injection pipe passing through the casing and offset from an axial direction of the injection passage, and a connecting member attached to the attachment portion to connect the injection pipe and the injection passage.

3. A refrigeration apparatus including the scroll compressor of claim 2, the refrigeration apparatus further comprising:

a refrigerant circuit connected with the scroll compressor, a refrigerant being circulated in the refrigerant circuit to perform a refrigeration cycle.

4. A refrigeration apparatus including the scroll compressor of claim 1, the refrigeration apparatus further comprising:

a refrigerant circuit connected with the scroll compressor, a refrigerant being circulated in the refrigerant circuit to perform a refrigeration cycle.

* * * * *